US010618786B2

(12) United States Patent
Parot et al.

(10) Patent No.: US 10,618,786 B2
(45) Date of Patent: Apr. 14, 2020

(54) AERIAL LIFT PLATFORM AND AERIAL LIFT EQUIPPED WITH SUCH A PLATFORM

(71) Applicant: HAULOTTE GROUP, L'horme (FR)

(72) Inventors: Sebastien Parot, Saint Martin la Plaine (FR); Philippe Luminet, Lyons (FR)

(73) Assignee: HAULOTTE GROUP, L'Horme (FR)

( * ) Notice: Subject to any disclaimer, the term of this patent is extended or adjusted under 35 U.S.C. 154(b) by 555 days.

(21) Appl. No.: 14/898,688

(22) PCT Filed: Jun. 16, 2014

(86) PCT No.: PCT/EP2014/062523
§ 371 (c)(1),
(2) Date: Dec. 15, 2015

(87) PCT Pub. No.: WO2014/202512
PCT Pub. Date: Dec. 24, 2014

(65) Prior Publication Data

US 2016/0214843 A1 Jul. 28, 2016

(30) Foreign Application Priority Data

Jun. 17, 2013 (FR) ..... 13 55661

(51) Int. Cl.
*B66F 11/04* (2006.01)
*B66F 17/00* (2006.01)

(52) U.S. Cl.
CPC ..... *B66F 11/044* (2013.01); *B66F 17/006* (2013.01)

(58) Field of Classification Search
CPC ..... B66F 11/044; B66F 17/006
See application file for complete search history.

(56) References Cited

U.S. PATENT DOCUMENTS 6,145,619 A 11/2000 Risser
9,676,602 B2 * 6/2017 Cummings ..... B66F 17/006
(Continued)

FOREIGN PATENT DOCUMENTS

CN 101284637 A 10/2008
CN 201952197 U 8/2011
(Continued)

OTHER PUBLICATIONS

International Search Report, dated Sep. 11, 2014, from corresponding PCT Application.

*Primary Examiner* — Alvin C Chin-Shue
*Assistant Examiner* — Candace L Bradford
(74) *Attorney, Agent, or Firm* — Young & Thompson

(57) ABSTRACT

The aerial lift platform includes a control station, a floor including a positioning zone for an operator maneuvering the control station, and a railing. The platform includes a protection device located on a surface of the railing. The zone and the protection device each extend on either side of a plane perpendicular to the first surface of the railing. A width of the protection device, measured perpendicular to the plane, is larger than 30 cm. The protection device is movable between: •—a retracted position, in which a protrusion height of the protection device relative to the railing, measured perpendicular to the floor, has a value below 10 cm, and •—a protection position, in which the protrusion height has a value above 30 cm. The railing includes an opening for accessing the platform, which can be at least partially obstructed by closing elements.

17 Claims, 7 Drawing Sheets

(56) References Cited

U.S. PATENT DOCUMENTS

| | | | | |
|---|---|---|---|---|
| 2002/0074186 | A1* | 6/2002 | Baldas | B66F 11/044 182/69.6 |
| 2010/0133043 | A1* | 6/2010 | Black | B66F 11/044 182/148 |

FOREIGN PATENT DOCUMENTS

| | | | |
|---|---|---|---|
| EP | 2 194 019 | B1 | 2/2012 |
| GB | 2472441 | A | 2/2011 |
| JP | H101298 | A | 1/1998 |
| JP | 2002-503632 | A | 2/2002 |
| JP | 2002-255489 | A | 9/2002 |
| JP | 2009-84033 | A | 4/2009 |
| KR | 20-2012-0006585 | U | 9/2012 |

* cited by examiner

AERIAL LIFT PLATFORM AND AERIAL LIFT EQUIPPED WITH SUCH A PLATFORM

BACKGROUND OF THE INVENTION

Field of the Invention

The present invention relates to an aerial lift platform, as well as an aerial lift equipped with such a platform.

Traditionally, an aerial lift comprises a motorized chassis, wheels, a telescoping mast articulated on the chassis and a moving platform where an operator can stand, arranged at the end of the telescoping mast. The platform has a control station allowing the operator to control the movement of the platform. When the operator is installed at the control station, he is generally facing the telescoping mast, which does not allow him to monitor obstacles located behind him.

Oftentimes, when the operator moves the platform, he is struck from behind by an obstacle. The operator is then pushed against the control station, which prevents him from stopping the movement of the platform.

To prevent these accidents, it is known to equip the platform with devices that detect a collision risk between the operator and the control station. For example, such detection devices comprise radars or cameras. However, these devices are difficult to adjust to be effective in environments with a complex geometry, such as metal construction frames, since it is necessary to distinguish between dangerous objects and objects on which the operator is working. It is in particular necessary to deactivate the sensors when the operator is positioned near an object on which he must perform a task.

Description of the Related Art

KR-20-2012-0006585 discloses an aerial lift platform equipped with a sensor assuming the form of a rod positioned in a corner of the platform and extending heightwise relative to a guardrail of the platform. When the rod comes into contact with an obstacle, the movement of the platform is stopped automatically. The effectiveness of this protection system is limited, since the rod only detects the obstacles that it encounters during an upward movement of the platform, which does not protect the operator from obstacles that arise laterally.

JP 2002-503632 discloses an aerial lift platform equipped with a safety device provided to protect the user from electrical risks. The relatively light structure of these safety devices makes them fragile, which does not make it possible to protect the operator from collisions and crushing risks. Furthermore, the safety devices have a geometry that obstructs the view of the operator standing on the platform. It is therefore provided to retract the safety device during movement of the platform, and to raise the safety device into a protection position when the platform is stopped and the operator wishes to work. Thus, during movement, the safety device does not protect the operator from collisions and crushing risks. No means are provided to force the operator to raise the protection device when he enters the platform.

BRIEF SUMMARY OF THE INVENTION

The aim of the present invention is to propose an aerial lift platform equipped with an effective protection system to prevent the collision between the obstacles and the operator maneuvering the platform.

To that end, the invention relates to an aerial lift platform, comprising:

- a control station,
- a floor including a positioning zone for an operator maneuvering the control station,
- a guardrail fastened on a perimeter of the floor,
- a protection device situated on a surface of the guardrail. The zone and the protection device each extend on either side of a plane perpendicular to the first surface of the guardrail. A width of the protection device, measured perpendicular to the plane, is greater than 30 cm, preferably greater than 60 cm. The protection device is movable between a retracted position, in which a protrusion height of the protection device relative to the guardrail, measured perpendicular to the floor, has a value below 10 cm, preferably below 1 cm, and a protection position, in which the protrusion has a value greater than 30 cm, preferably greater than 45 cm. The guardrail includes an opening for accessing the platform, which can be at least partially obstructed by closing means. The access by the operator to the platform, through the opening, requires positioning the protection device in the protection position.

Owing to the invention, the protection device provides mechanical protection for the operator by opposing the collision between an obstacle and the back of an operator steering the control device of the aerial lift. The protection device is retractable, which allows it to be deactivated when it is bothering the operator in the performance of a task.

According to advantageous but optional aspects of the invention, such an aerial lift platform may incorporate the following features, considered in any technically allowable combination:

- The platform comprises locking means that automatically lock the protection device in the protection position, without requiring additional action by the operator, when the protection device goes from the retracted position to the protection position.
- The access opening extends on either side of the plane.
- The protection device comprises a mechanical structure able to protect the operator from collisions with an obstacle.
- The mechanical structure comprises a globally U-shaped arched bar.
- The platform comprises first means for detecting the position of the protection device.
- The platform comprises means for visually signaling the position of the protection device.
- The platform comprises a second means for detecting collisions between the protection device and an obstacle and an electronic unit programmed to stop the movement of the platform when the second detection means detect a collision.
- The closing means comprise at least one shutter articulated on the protection device or a bar translatable in a direction perpendicular to the floor.

The invention also relates to an aerial lift that comprises a platform according to the invention.

BRIEF DESCRIPTION OF THE DRAWINGS

The invention will be better understood upon reading the following description, provided solely as a non-limiting example and done in reference to the appended drawings, in which.

DETAILED DESCRIPTION OF THE PREFERRED EMBODIMENTS

Figure 1:
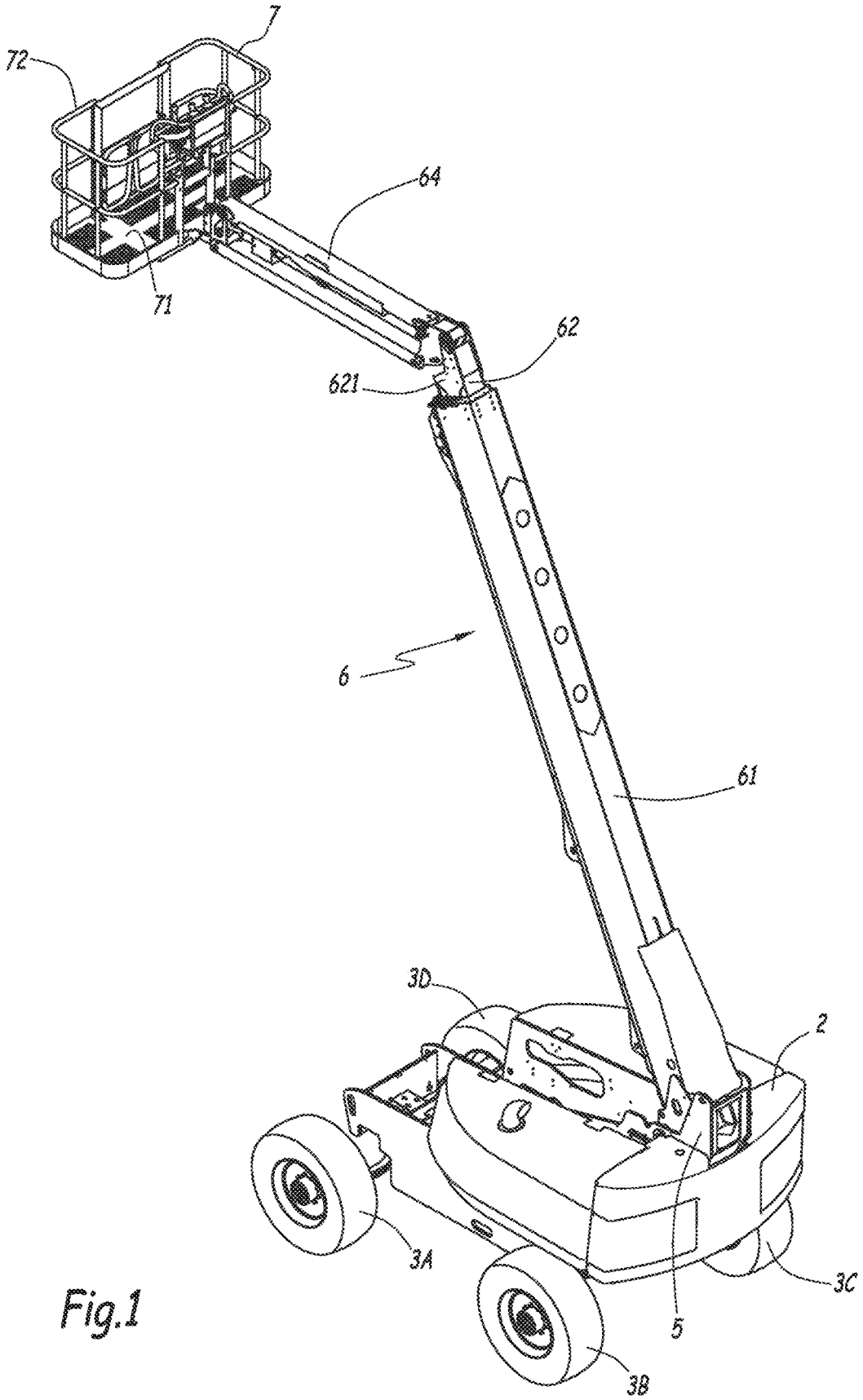
FIG. 1 is a perspective view of an aerial lift according to the invention.

FIG. 1 shows a vehicle 1 of the aerial lift type for people, according to the invention. The lift 1 comprises a motorized chassis 2 that rests on the surface of the ground before wheels 3A, 3B, 3C and 3D. In place of the wheels, the chassis 2 may be equipped with tracks forming other types of members for connecting to the ground.

A base 5 on which a telescoping mast 6 is articulated is mounted on the chassis 2. The mast 6 is telescoping in that it comprises a barrel 61 articulated on the base 5 and a part 62 suitable for sliding inside the barrel 61 while being controlled by a hydraulic jack.

The upper end of the part 62 of the mast, i.e., its end furthest from the barrel 61, is provided with a stirrup 621 for attaching to a parallelogram structure 64 on which a platform 7 is suspended where an operator can stand or on which loads to be transported to a height can be positioned.

The platform 7 comprises a floor 71 on which the feet of the operator rest. The floor 71 is globally rectangular and includes two long edges 71A and 71B that are opposite and parallel, as well as two short edges 71C and 71D that are perpendicular to the long edges 71A and 71B. A baseboard 73 surrounds the perimeter of the floor 71, which is formed by the edges 71A to 71D.

A guardrail 72 forming a protection barrier that is fixed on the perimeter 71A to 71D of the floor 71. The guardrail 72 comprises vertical 721 and horizontal 722 uprights, which form surfaces 72A, 72B, 72C and 72D of the guardrail 72, perpendicular to the floor 71. The surfaces 72A to 72D of the guardrail 72 are respectively adjacent to the edges 71A to 71D of the floor 71. The surfaces 72A and 72B are opposite and parallel to one another; the surfaces 72C and 72D are perpendicular to the surfaces 72A and 72B.

A control station 8 situated on the first surface 72A of the guardrail 72, which is fastened to the parallelogram structure 63. The control station 8 allows an operator on the platform 7 to control the movement of the platform 7 relative to the chassis 2 of the aerial lift 1, by moving the part 62 relative to the barrel 61 and modifying the geometry of the parallelogram structure 63.

An opening 724 for accessing the platform is arranged in the second surface 72B, opposite the control station 8. The access opening 724 is limited at the bottom by the baseboard 73, at the edge 71A of the floor 71, and on the sides by two vertical uprights 721 of the guardrail 72. The access opening 724 allows an operator to enter inside the guardrail 72 to be installed on the platform 7.

Reference P1 denotes a plane perpendicular to the floor 71 and the surfaces 72A and 72B of the guardrail 72, that plane being equidistant from the surfaces 72C and 72D. The control station 8 and the access opening 724 are each situated on either side of the plane P1, while each being centered on that plane.

A protection device 9 is situated on the first surface 72A of the guardrail 72. The protection device 9 comprises a mechanical structure formed by a globally U-shaped metal rigid arched bar, which comprises two vertical uprights 91 and 92 and one horizontal upright 93. The vertical uprights 91 and 92 are positioned against the vertical uprights 721 that delimit the opening 724.

Figure 2:
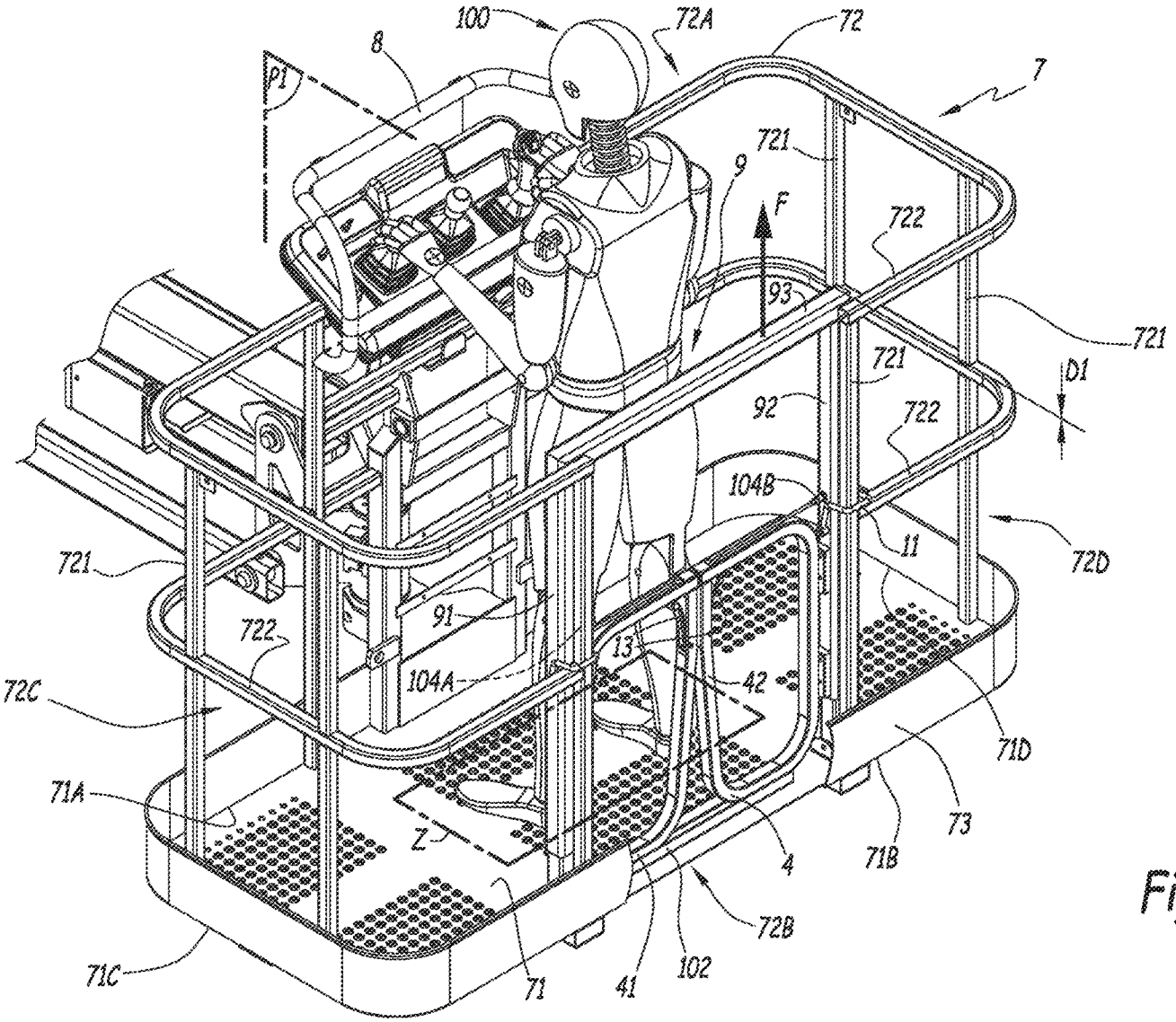
FIG. 2 is an enlarged perspective view, with partial cutaway and from another angle, of a platform that is part of the aerial lift of FIG. 1 and equipped with a protection device shown in the retracted position, an operator standing on the platform.

The protection device 9 is thus translatable, in a direction globally perpendicular to the floor 71, relative to the guardrail 72 and the floor 71, as shown by arrow F2 in FIG. 2. The protection device 9 is movable between a retracted position, shown in FIGS. 1 and 2, and a protection position, shown in FIG. 3.

Reference D denotes the protrusion height of the protection device 9 relative to the guardrail 72, measured perpendicular to the floor 71. The protrusion height D is measured between the zone of the protection device 9 furthest from the floor 71, and the zone of the guardrail 72 furthest from the floor 71. In the case at hand, the zone of the protection device 9 furthest from the floor 71 is formed by an upper surface 931 of the horizontal upright 93 of the protection device 9, turned opposite the floor 71. The zone of the guardrail 72 furthest from the floor 71 is formed by the horizontal uprights 722 of the guardrail 72 furthest from the floor 7.

In the retracted position, the protrusion height D has a first value D1 smaller than 10 cm, preferably smaller than 1 cm. In the example shown in FIGS. 1 and 2, the first value D1 is zero. In other words, the protection device 9 is flush with the upper edge of the guardrail 72.

In the protection position, the protrusion height has a second value D2 greater than 30 cm, preferably greater than 45 cm.

Generally, the height of the guardrail 72 is comprised between 1 m and 1.10 m. Thus, in the protection position, the height of the protection device, measured from the floor 71, is comprised greater than 1.30 m, preferably greater than 1.55 m.

Closing means 4 comprising two shutters 41 and 42 partially obstruct the access opening 724. The shutters 41 and 42 are each articulated on one of the vertical uprights 91 and 92 of the protection device 9, between a closed position, shown in FIGS. 1 to 3, and an open position, not shown in the figures. In the closed position, the shutters 41 and 42 are situated in the plane of the access opening 724. In the open position, the shutters 41 and 42 do not obstruct the access opening 724.

Locking means 10 make it possible to lock the closing means 4.

The locking means 10 comprise a rail 102, having a globally U-shaped cross-section, shown in FIG. 2 owing to a partial cutaway of the baseboard 73. The rail 102 is fastened on the floor 71, below the shutters 41 and 42. When the closing means 4 are in the closed position and when the protection device 9 is in the retracted position, the lower edge of the shutters 41 and 42 is housed in the rail 102, which blocks the opening of the shutters 41 and 42. Thus, The locking means 10 also comprise two fingers 104A and 104B that make it possible to lock the protection device 9 in the retracted position and in the protection position, by cooperating with holes, not shown in the figures, arranged in the vertical uprights 721 of the guardrail 721 of the guardrail 72 that border the access opening 724.

The locking means 10 are movable between a locked position, in which the fingers 104A and 104B are housed in the holes, and an unlocked position, in which the fingers 104A and 104B are outside the holes. When the locking means 10 are locked, the translation of the protection device 9 is blocked, such that the protection device cannot be moved by the operator between the retracted position and the protection position, or vice versa.

The position of the locking means 10 is controlled by control means 13 comprising two handles each fastened to one of the shutters 41 and 42, and two cables connecting each handle to one of the fingers 104A and 104B. The control means 13 are movable between an idle position, in which no action is exerted on handles and in which the fingers 104A and 104B are housed in the holes, and an activated position, in which the operator actuates the handles so as to remove the fingers 104A and 104B from the holes.

The locking means 10 are locked by default. When no action is exerted on the control means 13, the locking means 10 are locked and oppose the movement of the protection device 9.

The operation of the protection device 9 is as follows: the protection device 9 is initially in the retracted position, shown in FIGS. 1 and 2, with the closing means 4 in the closed position. The rail 102 blocks the opening of the closing means 4, such that the operator cannot push the shutters 41 and 42. Furthermore, as long as the operator does not act on the control means 13, the protection device 9 is blocked in the retracted position because the fingers 104A and 104B are housed in the holes. The operator therefore cannot raise the protection device 9 if he tries to grasp the horizontal upright 93 to raise it, as indicated by arrow F. Thus, the closing means 4 block the access opening 724 as long as the protection device 9 is in the retracted position.

To be able to access opening 724 freely and enter inside the guardrail 72, the operator must actuate control means 13 in order to unlock the locking means 10. In light of the arrangement of the control means 13, when the operator actuates the control means 13, his hand surrounds part of each shutter 41 and 42. Once the locking means 10 are unlocked, the operator can raise the protection device 9 to bring it into the protection position and can open the closing means 4 to enter the platform 4, since the rail 102 no longer blocks the movement of the shutters 41 and 42.

When the protection device 9 is in the protection position and the operator stops acting on the control means 13, the locking means 10 return to their locked position, which locks the protection device 9 in the protection position.

In the protection position, the arched bar 91, 92 and 93 of the protection device 9 forms mechanical protection for the operator. Indeed, when an obstacle arrives in the operators back, it is stopped or slowed by the protection device 9, which stops the obstacle and protects the operator from collisions.

Reference L9 denotes a width of the protection device 9, measured perpendicular to the plane P1. The width L9 corresponds to the length of the horizontal upright 93 and the spacing of the vertical uprights 91 and 92. The width L9 is greater than 30 cm, preferably greater than 60 cm. The width L9 globally corresponds to the width of the shoulders of an operator, so as to ensure effective protection for that operator.

Figure 7:
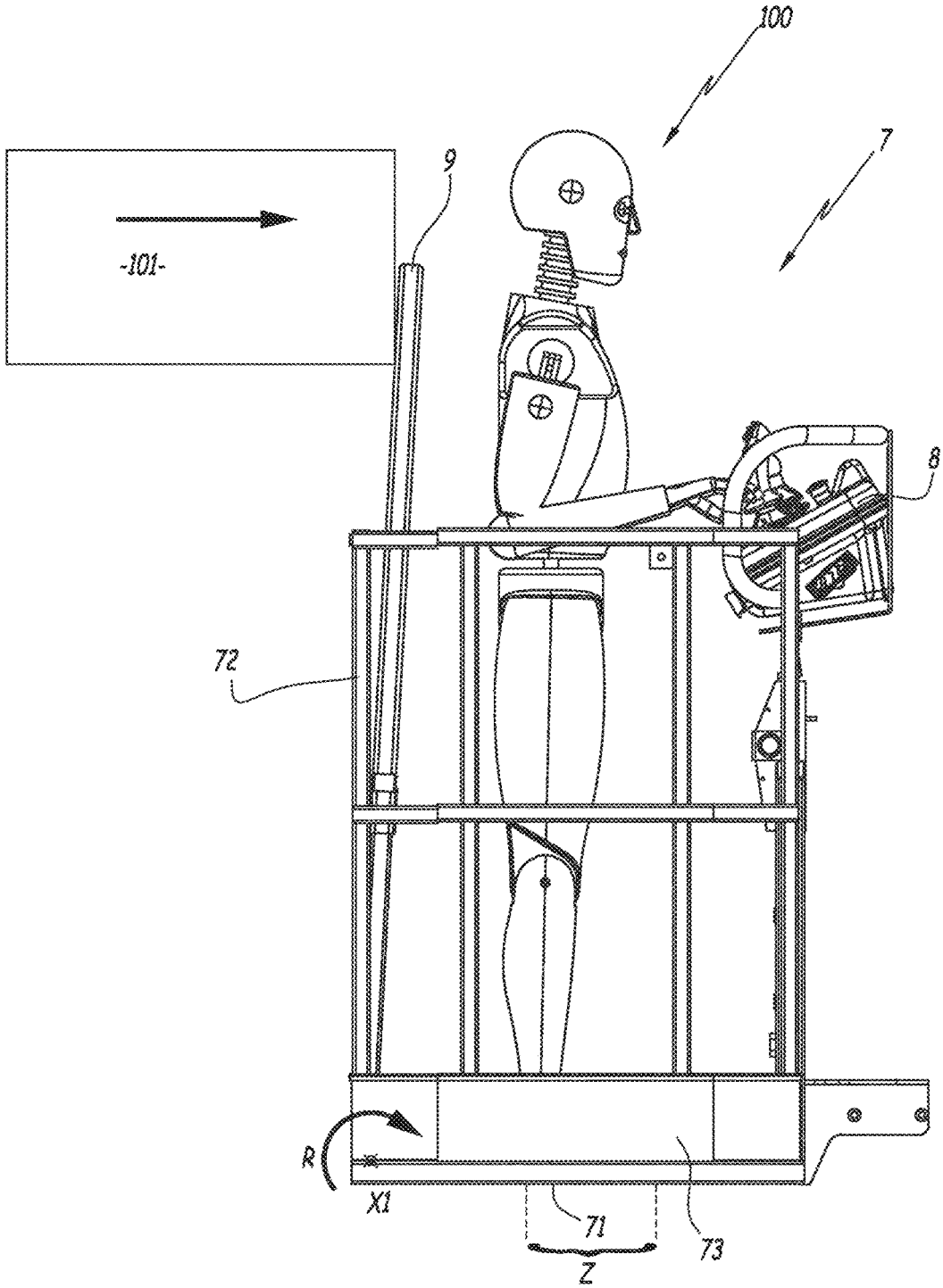
FIG. 7 is a side view of the platform of FIG. 3 on which an operator is positioned, the protection device being struck by an obstacle.

As shown in FIG. 7, when the protection device 9 is in the protection position, it is rotatable relative to the guardrail 72, around an axis X1 perpendicular to the plane P1, as shown by arrow R. A mechanical stop 11 makes it possible to stop the movement of the protection device 9, when it is struck by an obstacle from behind. First detection means, for example a feeler, make it possible to detect when the protection device 9 comes into contact with the mechanical stop 11. An electronic unit of the aerial lift 1, for example integrated into the control station 8, is programmed to stop any movement of the platform 7 automatically when the protection device 9 activates the detection means. In this way, operator safety is reinforced.

To be able to lower the protection device 9 into the retracted position, the operator must act on the control means 13, so as to unlock the locking means 10. This makes it possible to improve the safety of the aerial lift 1, since the protection device remains in the protection position by default, once the operator has placed it in that position.

Indeed, the locking means 10 automatically lock the protection device 9 in the retracted position, without requiring any additional action by the operator, when the protection device 9 goes from the retracted position to the protection position.

When the operator wishes to lower the protection device 9 into the retracted position, for example, when the protection device 9 is bothering him to perform a task, he must act on the control means 13 in order to unlock the locking means 10, which allows him to lower the protection device 9 into the retracted position.

The platform comprises second detection means, not shown, that detect the position in which the protection device 9 is located. The control station 8 comprises indicator means 12, such as a light-emitting diode, connected to the second detection means. The indicator means 12 visually indicate the position of the protection device 9 to the operator, which makes it possible to improve safety by indicating to the operator when the protection device 9 is in the retracted position and is not protecting him. This is particularly useful because when the operator uses the control station 8, he turns his back on the safety device 9.

Figure 4:
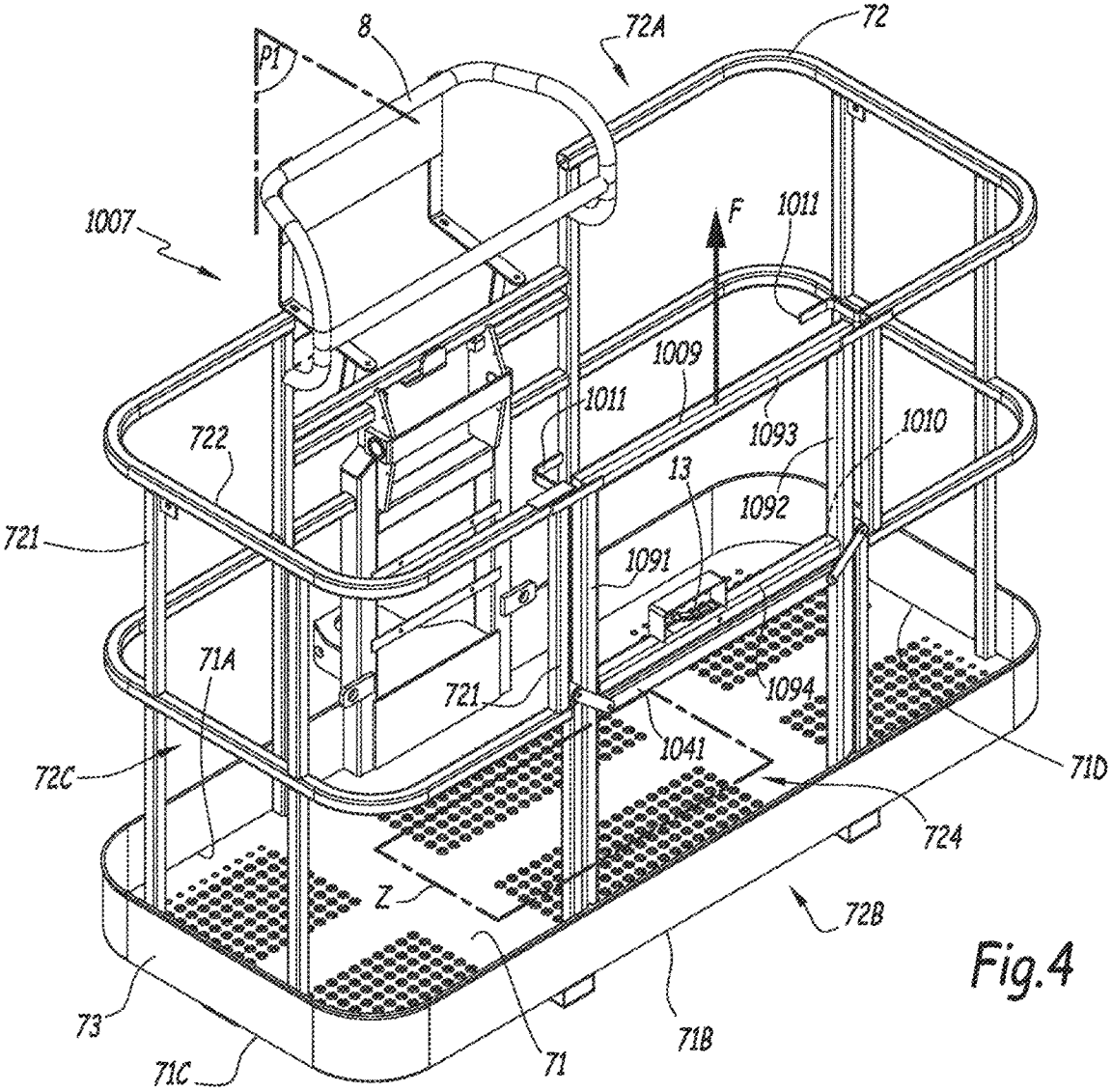
FIG. 4 is a view similar to FIG. 2 of an aerial lift platform according to a second embodiment of the invention and equipped with a protection device shown in a retracted position.
Figure 5:
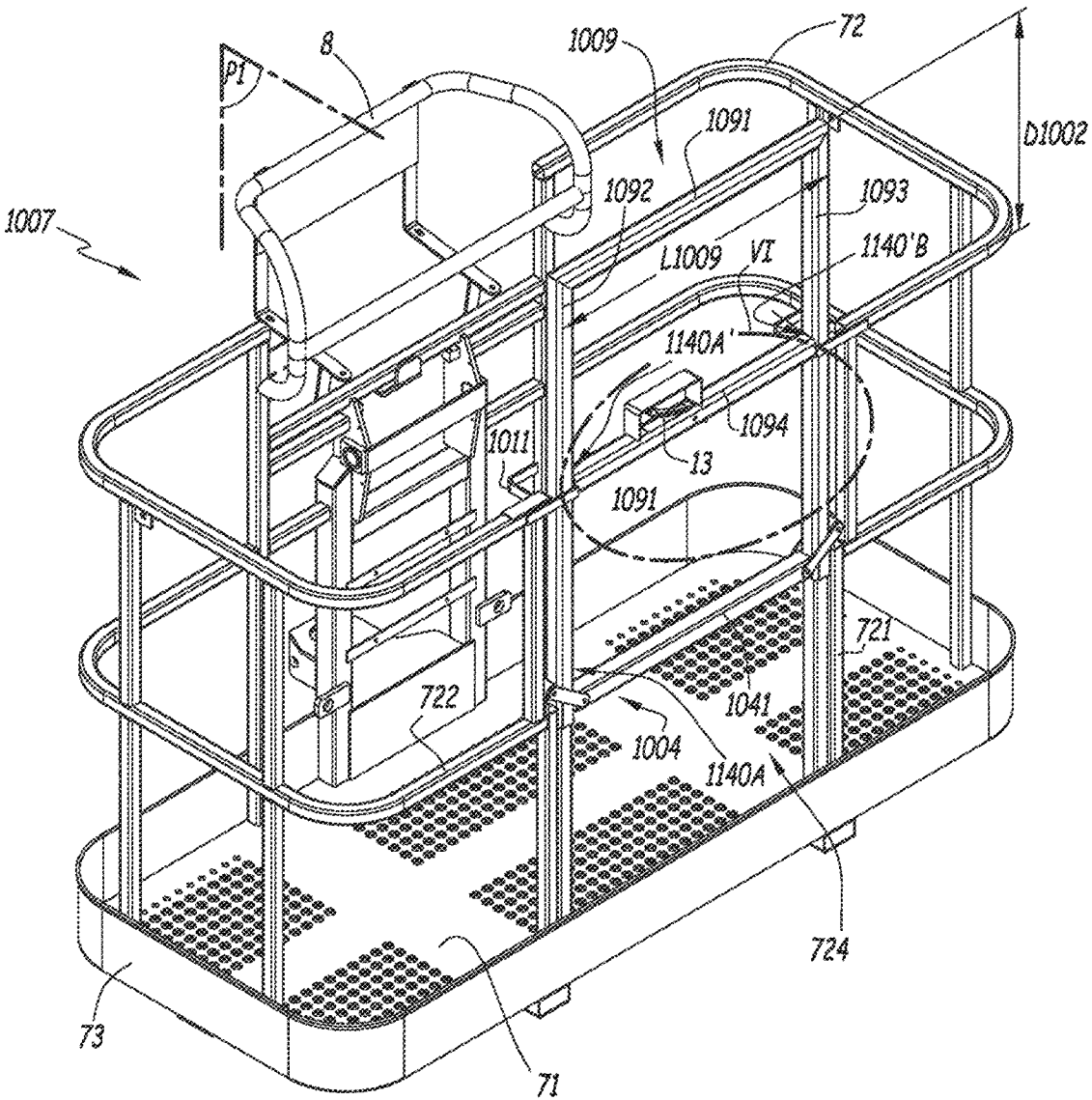
FIG. 5 is a view similar to FIG. 2 of the platform of FIG. 4 with the protection device shown in a protection position.

FIGS. 4 and 5 show a platform 1007 according to a second embodiment of the invention. Below, the elements of the platform 1007 that are similar to those of the platform 7 bear the same numerical references.

The platform 1007 is part of an aerial lift similar to that of FIG. 1. The platform 1007 includes a floor 71, a guardrail 72 including an access opening 724, a baseboard 73 and a control station 8. These elements are similar to those of the platform 7 and will not be described in detail below.

The lift 1007 comprises a protection device 1009 situated on a surface 72B of the guardrail 72 opposite the surface 72A along which the control station 8 is situated. The protection device 1009 comprises a globally U-shaped rigid metal arched bar, which comprises two vertical uprights 1091 and 1092 and one horizontal upright 1093. The protection device 1009 also comprises a transverse upright 1094 that connects the vertical uprights 1091 and 1092.

The protection device 1009 is translatable, in a direction globally perpendicular to the floor 71, relative to the guardrail 72 and the floor 71. The protection device 1009 is movable between a retracted position, shown in FIG. 4, and a protection position, shown in FIG. 5.

In the retracted position, a protrusion height D of the protection device 1009 relative to the guardrail 72 assumes a first value D1001, smaller than 10 cm, preferably smaller than 1 cm. In the example shown in FIG. 4, the first value D1001 is zero. In other words, the protection device 1009 is flush with the upper edge of the guardrail 72.

In the protection position, the protrusion height assumes a second value D1002 greater than 30 cm, preferably greater than 45 cm.

When the protection device 1009 is in the protection position, it is rotatable relative to the guardrail 72, around an axis X1 perpendicular to the plane P1. First detection means comprising a mechanical stop 1011 make it possible to detect when the protection device 9 comes into contact with the mechanical stop 1011, which occurs when an obstacle 101 strikes the protection device 1009. An electronic unit of the aerial lift 1, for example incorporated into the control station 8, is programmed to stop the movement of the platform 1007 automatically when the protection device 1009 activates the detection means. In this way, operator safety is reinforced.

Closing means 1004 comprising a crossbar 1041 partially obstruct the access opening 724. The crossbar 1041 is connected to the vertical uprights 721 of the guardrail 72 delimiting the access opening 724, using stirrups 1042 and 1043 that each encircle one of the vertical uprights 721. The crossbar 1041 is globally retained at mid-height of the access opening 724 by horizontal uprights 722 of the guardrail 72.

The closing means 1004 are translatable, along a direction perpendicular to the floor 71, between a closed position, shown in FIGS. 4 and 5, and an open position, not shown. In the closed position, the crossbar 1041 is situated globally at mid-height of the access opening 724. In the open position, the crossbar 1041 is situated in the upper part of the access opening 724 near the transverse upright 1094, such that the operator can cross the access opening 724 by passing below the elements 1041 and 1094.

Locking means 1010 make it possible to simultaneously lock the closing means 4 and the protection device 9.

Figure 6:
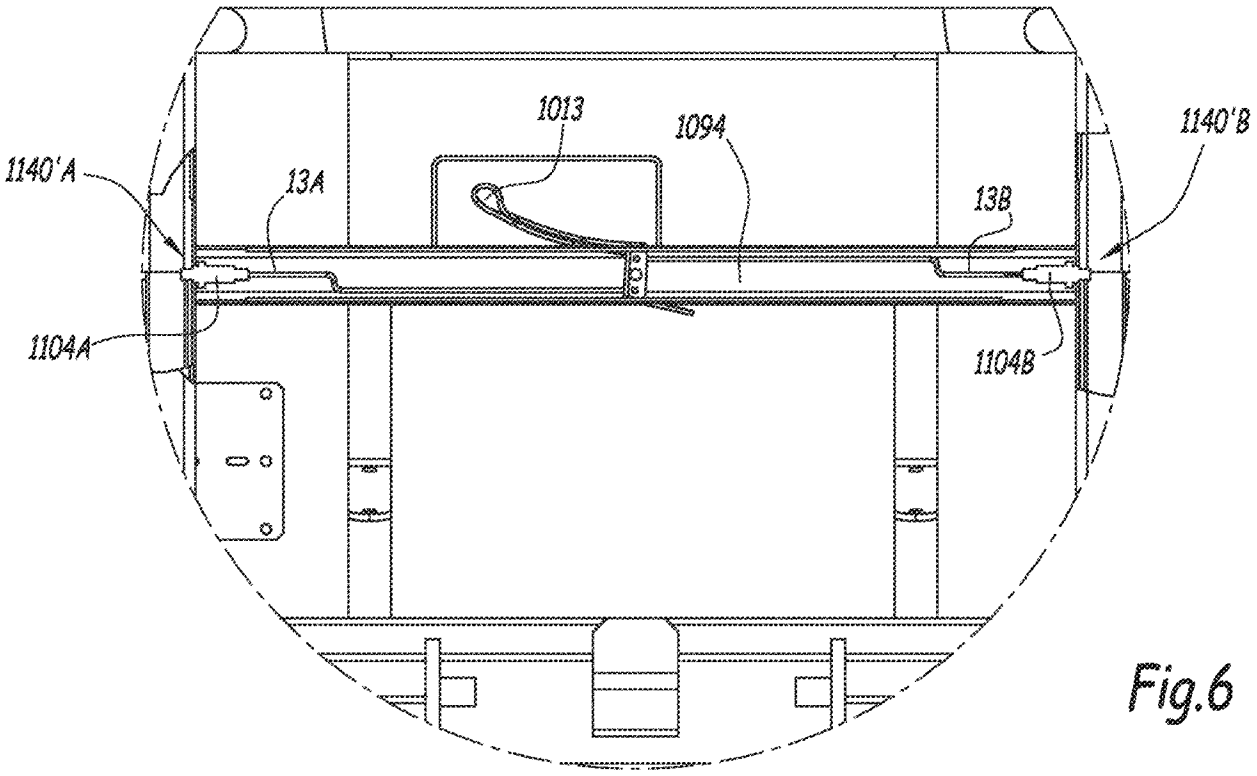
FIG. 6 is an enlarged front view of detail VI of FIG. 5.

The locking means 1010 comprise two fingers 1104A and 11046, visible in FIG. 6, which make it possible to lock the protection device 1009 in the retracted position and in the protection position.

The first finger 1104A is situated at the upright 1091 of the protection device 1009 and is able, when the protection device 1009 is in the retracted position, to penetrate a first hole 1140A formed by an opening arranged in a vertical upright 1091 and by an opening arranged in the guardrail 72.

The first finger 1104A is also able, when the protection device 1009 is in the protection device, to penetrate a second hole 1140'A that is further from the floor 71 than the first hole 1140A.

The second finger 1104B is situated at the upright 1092 of the protection device 1009 and is able, when the protection device 1009 is in the retracted position, to penetrate a third hole 1140B formed by an opening arranged in a vertical upright 1092 and by an opening arranged in the guardrail 72.

The second finger 1104B is also able, when the protection device 1009 is in the protection position, to penetrate a fourth hole 1140'B arranged in a vertical upright 92 and in the guardrail 72. The fourth hole 1140'B is further from the floor 71 than the third hole 1140B, and it is horizontally aligned with the second hole 1140'A.

The locking means 1010 are movable between a locked position, in which the fingers 1104A at 1104B are housed in the holes 1140A and 1140B, or 1140'A and 1140'B, and an unlocked position, in which the fingers 1104A and 1104B are outside the holes 1104A and 1104B, or 1104'A and 1104'B. When the locking means 1010 are locked, the translation of the closing means 1004 is blocked, such that the closing means 4 cannot be opened or closed by the operator, and the translation of the protection device 1009 is blocked, such that the protection device 9 cannot be moved by the operator between the retracted position and the protection position, or vice versa.

The position of the locking means 1010 is controlled by control means 13 comprising a handle fastened to the crossbar 1041 and connected to the two fingers 1104A and 1104B by cables 13A and 13B. The control means 13 are movable between an idle position, in which no action is exerted on the handle and in which the fingers 1104A and 1104B are housed in the holes 1104A and 1104B, or 1104'A and 1104'B, and an activated position, in which the operator actuates the handle so as to remove the fingers 1104A and 1104B outside the holes 1104A and 1104B, or 1104'A and 1104'B.

The locking means 1010 are locked by default. When no action is exerted on the control means 13, the locking means 1010 are locked and oppose the movement of the closing means 1004 and the movement of the protection device 1009.

Reference L1009 denotes a width of the protection device 1009, measured particular to the plane P1. The width L1009 corresponds to the length of the horizontal upright 1093 and the spacing of the vertical uprights 1091 and 1092. The width L9 is greater than 30 cm, preferably greater than 60 cm.

Figure 3:
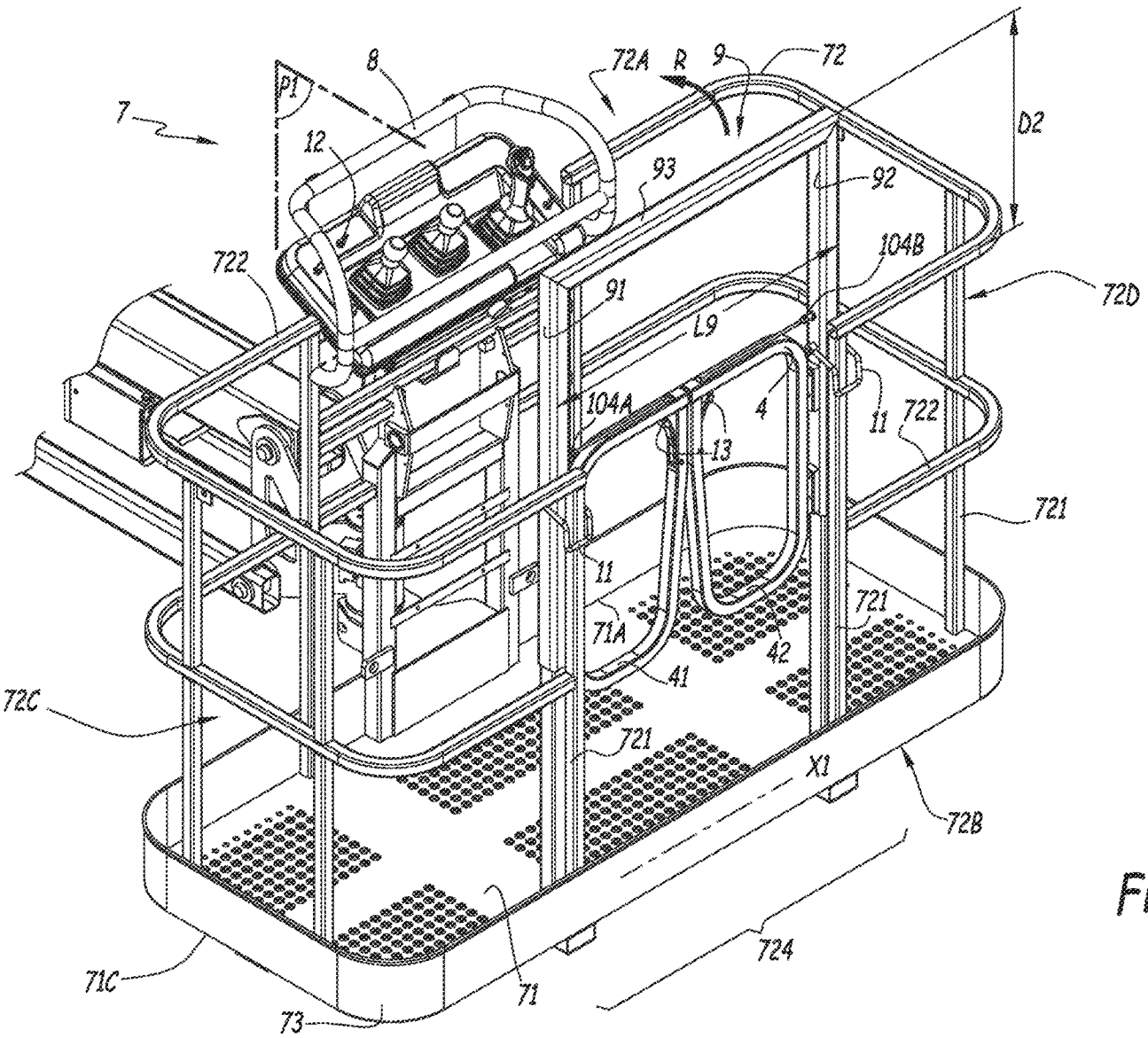
FIG. 3 is a view similar to FIG. 2 of the platform with the protection device shown in a protection position.

The operation of the protection device 1009 is the same as that of the protection device 9 described in reference to FIGS. 1 to 3.

According to another alternative of the invention, the access opening 724 and the closing means 4 or 1004 are situated on the surface 72C or 72D of the guardrail 72.

According to another alternative of the invention, not shown, the control station 8 is not centered on the surface 72A of the guardrail 72. For example, the control station 8 can be laterally offset relative to the plane P1, i.e., in a direction perpendicular to the plane P1. Alternatively, the control station 8 is situated on another surface of the guardrail 72, for example the surface 72C or 72D. In another alternative, the control station 8 is not situated on the surface of the guardrail 72, but is installed withdrawn toward the center of the platform 7, relative to the guardrail 72.

In all cases, to ensure the safety of the operator 100, it is necessary for the protection device 9 to be situated behind the operator 100 when the latter is maneuvering the control station 8. A zone Z is defined on the floor 71 for positioning of the operator 100 maneuvering the control station 8, the outlines of which are shown in mixed lines in FIGS. 2 and 4. The zone Z contains the contact zone between the feet of the operator 100 and the floor 71, when the operator 100 is upright and his hands are positioned on the control elements of the control station 8.

To ensure the safety of the operator, the zone Z and the protection device 9 each extend on either side of the plane P1, which is perpendicular to the surface 72B of the guardrail 72 on which the protection device 9 is situated. Thus, when the protection device 9 is not centered on the surface 72A of the guardrail 72, the protection device 9 ensures protection of the operator 100.

Other embodiments can be implemented by combining the features of the embodiments and alternatives mentioned above.

The invention claimed is:

1. An aerial lift platform, comprising:

a control station, a floor including a positioning zone for an operator maneuvering the control station, a guardrail fastened on a perimeter of the floor, the guardrail including an access opening for accessing the platform, and a closing shutter which at least partially obstructs the access opening, wherein the closing shutter is articulated between a closed position and an open position, and a protection device situated on a surface of the guardrail, wherein the positioning zone and the protection device each extend on either side of a first plane perpendicular to the surface of the guardrail, wherein a width of the protection device, measured perpendicular to the first plane is greater than 30 cm, and the protection device is movable between:

a retracted position, in which a protrusion height of the protection device relative to the guardrail, measured perpendicular to the floor, has a first value smaller than 10 cm, and a protection position, in which the protrusion height has a second value greater than 30 cm as measured with respect to the guardrail perpendicular to the floor of the platform, wherein access by the operator to the platform, through the access opening, requires positioning the protection device in the protection position, and wherein positioning the protection device in the protection position unlocks the closing shutter to thereby allow the closing shutter to selectively be in i) the open position where the closing shutter is opened and allows access by the operator to the platform, and ii) the closed position where the closing shutter remains closed.

2. The platform according to claim 1, wherein the platform comprises a lock assembly that automatically locks the protection device in the protection position, without requiring additional action by the operator, when the protection device goes from the retracted position to the protection position.

3. The platform according to claim 2, wherein, the protection device comprises a mechanical structure formed by a globally U-shaped rigid arched bar, the arched bar comprising two vertical uprights and one horizontal upright, the two vertical uprights being positioned against respective guardrail vertical uprights that delimit the access opening, the closing shutter is articulated on one of the two vertical uprights of the protection device, between the closed position, and the open position, where in the closed position, the shutter is situated in a second plane, and in the open position, the shutter is not in the second plane and does not obstruct the access opening, the second plane being different from the first plane, the locking assembly comprises a rail having a globally U-shaped cross-section, the rail being located at the floor below the shutter, and with the shutter in the closed position and the protection device in the retracted position, an lower edge of the shutter is housed in U-shaped cross-section of the rail, which blocks the opening of the shutter.

4. The platform according to claim 1, wherein the access opening extends on either side of the first plane.

5. The platform according to claim 1, wherein the protection device comprises a mechanical structure, the mechanical structure providing a barrier between an obstacle and a back of the operator.

6. The platform according to claim 5, wherein, the mechanical structure is rotatable relative to the guardrail around an axis perpendicular to the first plane to so that upon impact from the obstacle from behind the operator, the mechanical structure rotates relative to the guardrail.

7. The platform according to claim 6, wherein the mechanical structure comprises a U-shaped arched bar and a mechanical stop that limits rotation of the U-shaped arched bar relative to the guardrail around the axis perpendicular to the first plane perpendicular to the surface of the guardrail.

8. The platform according to claim 1, further comprising a position detector arranged to detect the position of the protection device by detecting contact of the protection device with the mechanical stop.

9. The platform according to claim 8, further comprising a visual indicator that visually indicates the position of the protection device.

10. The platform according to claim 1, further comprising a collision detector operatively connected to an electronic unit, the collision detector comprising a mechanical stop, an obstacle striking the mechanical stop triggering the electronic unit to stop the movement of the platform.

11. The platform according to claim 1, wherein the closing shutter is articulated on the protection device in a direction perpendicular to the floor.

12. An aerial lift, which comprises a platform according to claim 1.

13. The platform according to claim 1, wherein, the width of the protection device, measured perpendicular to the first plane is greater than greater than 60 cm, the first value of the retracted position, in which a protrusion height of the protection device relative to the guardrail, measured perpendicular to the floor, is smaller than 1 cm, and the second value of the protection position, in which the protrusion height is greater than 45 cm.

14. The platform according to claim 1, wherein the closing shutter is articulated on a bar translatable in a direction perpendicular to the floor.

15. The platform according to claim 1, further comprising a visual indicator that visually indicates when the protection device is in the retracted position and is therefore not protecting the operator.

16. The platform according to claim 1, wherein, the protection device comprises a mechanical structure formed by a globally U-shaped rigid arched bar, the arched bar comprising two vertical uprights and one horizontal upright, the two vertical uprights being positioned against respective guardrail vertical uprights that delimit the access opening, when the protection device is in the protection position, upon impact from an obstacle from behind the operator, the mechanical structure is rotatable relative to the guardrail, around an axis perpendicular to the first plane perpendicular to the surface of the guardrail.

17. The platform according to claim 16, wherein, the protection device further comprises a mechanical stop that limits and stops the rotation of the mechanical structure when struck by the obstacle from behind, the mechanical stop is attached to one of the two vertical uprights and extending around one of the guardrail vertical uprights that delimit the access opening, and during the rotation of the mechanical structure, the mechanical stop acts against the one of the guardrail vertical uprights that delimit the access opening to limit to stop the rotation of the mechanical structure.

* * * * *